US009970149B2

(12) United States Patent
Bao et al.

(10) Patent No.: US 9,970,149 B2
(45) Date of Patent: May 15, 2018

(54) DETERGENT DOSING CONTROLLER

(71) Applicant: HANGZHOU KAMBAYASHI ELECTRONICS CO., LTD., Hangzhou, Zhejiang Province (CN)

(72) Inventors: Pengfei Bao, Hangzhou (CN); Weixuan Lao, Hangzhou (CN)

(73) Assignee: HANGZHOU KAMBAYASHI ELECTRONICS CO., LTD., Hangzhou, Zhejiang Province (CN)

( * ) Notice: Subject to any disclaimer, the term of this patent is extended or adjusted under 35 U.S.C. 154(b) by 0 days. days.

(21) Appl. No.: 15/129,146

(22) PCT Filed: Aug. 14, 2014

(86) PCT No.: PCT/CN2014/084441

§ 371 (c)(1),
(2) Date: Sep. 26, 2016

(87) PCT Pub. No.: WO2015/143820

PCT Pub. Date: Oct. 1, 2015

(65) Prior Publication Data

US 2017/0167068 A1 Jun. 15, 2017

(30) Foreign Application Priority Data

Mar. 27, 2014 (CN) ..... 2014 1 0121405

(51) Int. Cl.
*D06F 39/02* (2006.01)
*B01F 5/04* (2006.01)
(Continued)

(52) U.S. Cl.
CPC ..... *D06F 39/028* (2013.01); *A47L 15/449* (2013.01); *A47L 15/4418* (2013.01);
(Continued)

(58) Field of Classification Search
CPC ..... Y10T 137/87684; Y10T 137/4857; Y10T 137/87346; Y10T 137/0424;
(Continued)

(56) References Cited

U.S. PATENT DOCUMENTS 3,447,505 A * 6/1969 Wagner ..... B01F 3/088 118/704
5,193,594 A * 3/1993 Johansson ..... B67D 7/744 141/103
(Continued)

FOREIGN PATENT DOCUMENTS

CN 201258409 6/2009
CN 103306108 9/2013
(Continued)

*Primary Examiner* — Atif Chaudry
(74) *Attorney, Agent, or Firm* — Muncy, Geissler, Olds & Lowe, P.C.

(57) ABSTRACT

A detergent dosing controller that is convenient to use and has better effect is disclosed herein. One side of the main passage is a water inlet (101), another side of the main passage is outlet (102) connecting to liquid inlet of washing bucket, and valves A(2), B(3), C(4), D(5), pump (6) and nozzle (7) are equipped. The inlet of valve A connects to the bypass orifice A(a) of the main passage, inlet of valve B connects to liquid storage tank of detergent A, outlets of valve A and valve B connect to inlet of valve C, inlet of valve D connects to liquid storage tank of detergent B, outlets of valve C and valve D connect to inlet of the pump, outlet of the pump connects to bypass orifice B(b) of the main passage, and for the relative location of bypass orifices A and B of main passage, bypass orifice A is relatively close to the inlet of main passage, bypass orifice B is relatively close to the outlet of main passage, the nozzle connects to main passage by concatenation and between bypass orifices A and B. The invention is applicable to the dosing of detergent for electric washing equipments.

4 Claims, 7 Drawing Sheets

(51) Int. Cl.

| | |
|---|---|
| ***A47L 15/04*** | (2006.01) |
| ***B08B 3/02*** | (2006.01) |
| ***A47L 15/44*** | (2006.01) |
| ***B67D 7/02*** | (2010.01) |
| ***B67D 7/36*** | (2010.01) |
| ***B67D 7/58*** | (2010.01) |

(52) U.S. Cl.
CPC ..... *A47L 15/4427* (2013.01); *B01F 5/0413* (2013.01); *B01F 5/0415* (2013.01); *B01F 5/0428* (2013.01); *B08B 3/026* (2013.01); *B67D 7/02* (2013.01); *B67D 7/36* (2013.01); *B67D 7/58* (2013.01); *D06F 39/022* (2013.01); *A47L 2601/02* (2013.01); *B08B 2203/0217* (2013.01); *B08B 2203/0229* (2013.01); *D06F 2202/08* (2013.01); *D06F 2204/02* (2013.01); *D06F 2204/08* (2013.01); *Y10T 137/0424* (2015.04); *Y10T 137/2599* (2015.04); *Y10T 137/4857* (2015.04); *Y10T 137/87281* (2015.04); *Y10T 137/87346* (2015.04); *Y10T 137/87595* (2015.04); *Y10T 137/87684* (2015.04)

(58) Field of Classification Search
CPC ..... Y10T 137/87281; Y10T 137/87595; Y10T 137/2599; A47L 15/4427; A47L 15/4418; B08B 3/026; B08B 2203/0217; B08B 2203/0229; D06F 39/022; D06F 39/02; D06F 39/028; D06F 2204/02; D06F 2204/08; D06F 2202/08; B01F 5/0428; B01F 5/0413; B01F 5/0415
See application file for complete search history.

(56) References Cited

U.S. PATENT DOCUMENTS

| | | | | |
|---|---|---|---|---|
| 6,799,883 | B1 * | 10/2004 | Urquhart | B01F 15/00227 137/3 |
| 2009/0126123 | A1 * | 5/2009 | Kim | D06F 33/02 8/137 |
| 2013/0220025 | A1 * | 8/2013 | Erta Carrera | G01F 1/00 73/861 |

FOREIGN PATENT DOCUMENTS

| | | |
|---|---|---|
| CN | 103397496 | 11/2013 |
| CN | 103898715 | 7/2014 |
| CN | 203834223 | 9/2014 |
| JP | 61-172594 | 2/1988 |
| JP | 2000334197 | 12/2000 |
| WO | WO 2011087254 | 7/2011 |

* cited by examiner

F direction

A-A

B-B

C-C

E-E

DETERGENT DOSING CONTROLLER

FIELD OF THE INVENTION

This invention relates to the dosing device for liquid detergent, in particular to a liquid detergent dosing control device which is installed in electric washing machines, such as electric washing machines and electric dishwasher.

BACKGROUND OF THE INVENTION

In prior art, a liquid detergent (softening agent, softener and sterilizing solution) is put into the specified vessel beforehand of electric washing machine and electric dishwasher by users, then fed into the washing bucket by washing equipment by means of water washing or other mechanical method according to the washing process. By such method, the dosing quantity of detergent depends on users' operation, and detergent should be fed into vessel each washing time. With the increase of liquid detergent, it is a trend to put plenty of detergent into washing equipment, by this method, users can dose certain amount of detergent into washing equipment during washing process according to demands, to reduce operation steps, and automatically adjust dosing quantity of detergent according to types and quantity of washes. Therefore, it is a development trend to equip an automatic dosing device into the washing machine.

Japan Patent Office (JPO) 61-172594 disclosed that air pump can exert certain pressure to control the opening time of valve to control the dosing quantity of liquid detergent filled in the washing machine vessel. JPO 2000-334197 disclosed that the liquid detergent filled in the vessel can be extruded by exerting pressure to detergent. In these solutions, users need to fully seal the groove cover after liquid detergent is filled into liquid detergent groove. In case of poor sealing, the pump pressure leakage will occur. Even if the pump pressure is same, liquid detergent of different viscosity will be different in flow velocity under same pressure, leading to inaccurate dosing quantity. In addition, the pump noise will affect noise index control of washing equipment.

In Chinese markets, some washing equipments are equipped with liquid detergent tanks at the bottom. The liquid detergent is fed or sucked to water tank at top of washing equipment by pressure produced by gear pump, then to the washing bucket. In this solution, the gear pump is often immersed into the detergent, after detergent runs out, the residual detergent in pump will be dry and solidified, when using the washing machine again, more damping will hinder rotation of gear in gear pump. The work noise in gear pump can't better control noise indexes of washing equipment. In addition, this solution has dosing errors due to dosing speed difference resulting from detergent viscosity fluctuation.

JPO 11-019391 provides a solution, namely, a water pump is equipped in the washing machine, the water pump sucks water from washing bucket of washing machine or bathing pool to a nozzle on pipeline of washing bucket, a negative pressure generator is installed on the nozzle, when water flows out of the pump, the negative pressure of nozzle can suck the detergent to main water flow, then to washing bucket after mixing. The power in this technology can prevent sealing problem of air pump power solution and solidification of residual detergent in gear pump solution, but a constant-pressure water pump should be equipped, which leads to higher cost.

CN201258409Y document discloses the device that can produce negative pressure by water flow, but the negative pressure is produced through flow of tap water, and negative pressure is closely related to tap water pressure and flow, therefore, the negative pressure resulting from water dosing of solenoid valve in washing equipment changes greatly, the detergent dosing precision can't be controlled easily.

In Example 1, in order to overcome the above problems, the detergent filling measurement box sucks the detergent by residual negative pressure in measurement box under the premise of cutoff of negative pressure source and measurement box space, and if the negative pressure is inadequate, the measuring space can't be filled to the full, leading to low dosing precision, if the measuring box is not sealed well, the dosing error will be bigger. Additionally, the detergent filled in measuring box is sucked to main water flow by negative pressure, therefore, the detergent will be left over between valve and pipeline, and these concentrated or solidified detergents will hinder flow of detergent, possibly affecting the dosing effect.

A liquid detergent dosing device disclosed in CN 103397496A comprises a main passage, a valve A, a valve B, a valve C, a valve D, a liquid collection chamber, a backflow passage and a Venturi negative pressure generator. The structure is characterized by simple structure, small volume, easy to install and use, high dosing precision of detergent and detergent not easy to remain. But in this device, the water/detergent mixed liquid flows through outlets of valve C or valve C and valve D, then into liquid collection chamber, liquid in liquid collection chamber flows to Venturi negative pressure generator through backflow passage, outlet of Venturi negative pressure generator connects to inlet of main passage. Therefore, during process of water/detergent mixed liquid flowing through main passage to washing bucket, partial mixed liquid will flow through inlet section of valve A (bypassing with main passage) to circulation area where detergent doses, leading to dosing quantity error or poor dosing efficiency. In addition, the liquid collection chamber in this device is relatively big, dosing efficiency of water/detergent mixed liquid resided in liquid collection chamber is relatively low, the mixed liquid can't be easily fed by washing in a short time.

SUMMARY OF THE INVENTION

The object of the invention is to resolve some problems in liquid detergent dosing device installed in existing washing equipment, such as complicated structure, poor dosing precision, equipment operation hindered by remaining and solidification of detergent, low detergent dosing efficiency. To this end, the present invention provides a kind of detergent dosing controller, characterized by simple structure, small volume, easy to install and use, detergent not easy to be left over in equipment, high dosing precision and efficiency.

To resolve above problems, two technical solutions are adopted in this invention, namely first solution: valves A, B, C and D; second solution: valves A, B, C, D, E and F.

In the first solution, a main passage is equipped, one side is water inlet, other side is outlet connecting to liquid inlet of washing bucket, characteristics: equipped with valves A, B, C, D, pump and nozzle. Inlet of valve A connects to bypass orifice A of the main passage; inlet of valve B connects to liquid storage tank of detergent A; outlets of valve A and valve B connect to inlet of valve C; inlet of valve D connects to liquid storage tank of detergent B; outlets of valve C and valve D connect to inlet of the pump;

pump outlet connects to bypass orifice B of the main passage; relative location of the bypass orifice A and B of main passage: bypass orifice A is relatively close to the inlet of main passage, bypass orifice B is relatively close to the outlet of main passage; the nozzle connects to the main passage by concatenation and between bypass orifice A and B, and the nozzle inlet faces to the inlet of main passage, while the outlet faces to the outlet of main passage.

Preferably, in this solution, an integrated valve is installed, the valves A, B, C and D are installed in this integrated valve, the valve A has inlet A and valve seat A, valve B has inlet B and valve seat B, valve C has inlet C and valve seat C, valve D has inlet D and valve seat D. The integrated valve has chamber 1 and 2, when valve seat A is under open state, chamber 1 connects to inlet A, when valve seat C is under open state, chamber 1 connects to chamber 2, chamber 2 has an inlet. This integrated valve is equipped with solenoid valve assembly 1 and 2; solenoid coil 1 is equipped in solenoid valve assembly 1, in its guide sleeve, plunger 1 is equipped and its front end connects to plunger cap 1; solenoid coil 2 is equipped in solenoid valve assembly 2, in its guide sleeve, plunger 2 is equipped and its front end connects to plunger cap 2;

The valve A and valve B correspond to solenoid valve assembly 1, the valve seat A and valve seat B connect to chamber 1 of integrated valve and face to axis in chamber 1, keeping certain distance away from the axis, plunger cap 1 of solenoid valve assembly 1 is within the distance scope of valve seat A and valve seat B. Under normal state, plunger cap 1 can close valve seat B while open valve seat A, this normal state refers to non-energized state of solenoid coil 1.

The valve C and valve D correspond to solenoid valve assembly 2, valve seat C and valve seat D connect to chamber 2 of integrated valve and face to axis in chamber 1, keeping certain distance away from the axis, plunger cap 2 of solenoid valve assembly 2 is within the distance scope of valve seat C and valve seat D. Under normal state, plunger cap 2 can close valve seat D while opening valve seat C, this normal state refers to non-energized state of solenoid coil 2.

Preferably, in this invention, an integrated body is installed, the pump, main passage with nozzle and integrated valve are equipped in this integrated body. The inlet A connects to bypass orifice A, inlet C connects to chamber 1, chamber 2 outlet connects to pump inlet.

The main passage can be set at upper right part of integrated body, pump can be set at upper left part of integrated body, and the integrated valve can be set at lower part of integrated body. The pump is equipped with a motor.

In the second solution, a main passage is equipped, one side is water inlet, other side is outlet connecting to liquid inlet of washing bucket, characteristics: equipped with valves A, B, C, D, E and F, pump and nozzle. Inlet of valve A connects to the bypass orifice A of the main passage; inlet of valve B connects to liquid storage tank of detergent A; outlets of valve A and valve B connect to inlet of valve C; inlet of valve D connects to liquid storage tank of detergent B; outlets of valve C and valve D connect to inlet of valve E; inlet of valve F connects to liquid storage tank of detergent C; outlets of valve E and valve F connect to inlet of the pump; outlet of pump connects to bypass orifice B of the main passage. Relative location of bypass orifice A and B of main passage: bypass orifice A is relatively close to the inlet of main passage, bypass orifice B is relatively close to the outlet of main passage. The nozzle connects to main passage by concatenation and between bypass orifice A and B, nozzle inlet faces to the inlet of main passage, while outlet faces to the outlet of main passage.

Preferably, in this solution, an integrated valve is installed, the valves A, B, C, D, E and F are equipped in this integrated valve, they are equipped with valve seats A, B, C, D, E and F. This integrated valve has chambers 1, 2 and 3. When valve seat A is under open state, chamber 1 connects to inlet of valve A; when valve seat C is under open state, chamber 1 connects to chamber 2; when valve seat E is under open state, chamber 2 connects to chamber 3, chamber 3 has an outlet. This integrated valve is equipped with solenoid valve assembly 1, 2 and 3; solenoid coil 1 is equipped in solenoid valve assembly 1, in its guide sleeve, plunger 1 is equipped and its front end connects to plunger cap 1; solenoid coil 2 is equipped in solenoid valve assembly 2, in its guide sleeve, plunger 2 is equipped and its front end connects to plunger cap 2; solenoid coil 3 is equipped in solenoid valve assembly 3, in its guide sleeve, plunger 3 is equipped and its front end connects to plunger cap 3;

The valve A and valve B correspond to solenoid valve assembly 1, valve seat A and valve seat B connect to chamber 1 of integrated valve and face to axis in chamber 1, keeping certain distance away from the axis, plunger cap 1 of solenoid valve assembly 1 is within the distance scope of valve seat A and valve seat B. Under normal state, plunger cap 1 can close valve seat B while opening valve seat A, this normal state refers to non-energized state of solenoid coil 1.

The valve C and valve D correspond to solenoid valve assembly 2, the valve seat C and valve seat D connect to chamber 2 of integrated valve and face to axis in chamber 2, keeping certain distance away from the axis, plunger cap 2 of solenoid valve assembly 2 is within the distance scope of valve seat C and valve seat D. Under normal state, plunger cap 2 can close valve seat D while opening valve seat C, this normal state refers to non-energized state of solenoid coil 2.

The valve E and valve F correspond to solenoid valve assembly 3, valve seat E and valve seat F connect to chamber 3 of integrated valve and face to axis in chamber 3, keeping certain distance away from the axis, plunger cap 3 of solenoid valve assembly 3 is within the distance scope of valve seat E and valve seat F. Under normal state, plunger cap 3 can close valve seat F while opening valve seat E, this normal state refers to non-energized state of solenoid coil 3.

The detergent in this invention refers to liquid detergent. In the first solution, the detergent A is a kind of detergent, while detergent B is the other kind of detergent; the valve B in this invention is for dosing detergent A, valve D is for dosing detergent B. Detergents A and B can be fed simultaneously, and either detergent A or B can fed only.

The operation sequence is as follows: during dosing water into inlet of main passage, firstly open valve A and valve C, while close valve B and valve D, the partial inflow water will pass through valve A, valve C, pump inlet and outlet, then collected at the main passage, into washing bucket together with inflow water. The split-flow loop can flush pump and relevant flow path, to prevent residual and solidified detergent from affecting operation. After flushing, close valve A, open valve B and/or valve D, the detergent A and/or detergent B in liquid storage tank pass through valve B, valve C and/or valve D into the liquid collection chamber, mixed with the previous flushing water, then mixed with inflow water and into washing bucket, now, the detergent A and/or detergent B has been fed.

In this invention, small amount of split-flow water of inflow water in main passage flows through valve A, valve C and the pump, then into washing bucket together with inflow water, it can flush pump and relevant flow path, to prevent residual and solidified detergent from affecting operation. The detergent dosing controller features duplex structures (assemblies), valve A and valve B are in one assembly, while valve C and valve D are in other one. Based on same principle, triple structures are available, namely valve E and valve F are supplemented into the duplex structures.

Compared to the duplex structures, the triple structures can be used more widely.

Based on same principles, more than triple structures can be available, such as quadruple structure, valve G and H are supplemented into triple structure, in this structure, outlets of valve E and valve F connect to inlet of valve G, and inlet of valve H connects to liquid storage tank of detergent D.

The invention is further described in combination with drawings and specific embodiments.

SIGNS AND CORRESPONDING COMPONENTS IN THE FIGURES

Figure 1:
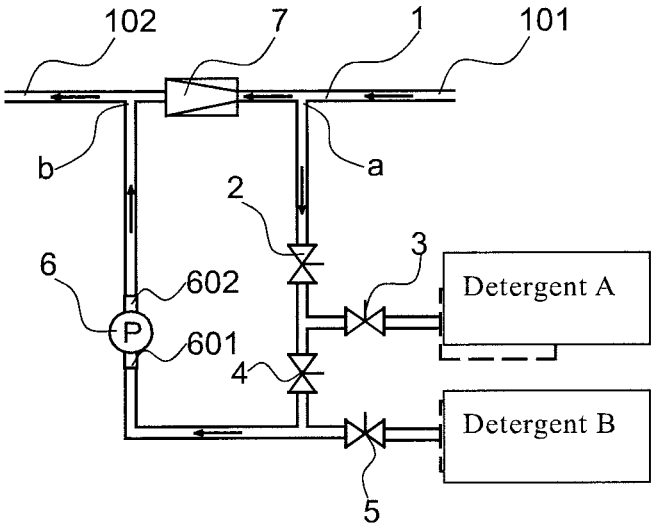
FIG. 1 is a Schematic Diagram of a Duplex Structure.

1: main passage; 101: inlet; 102: outlet; 2: valve A; 201: inlet A; 202: valve seat A; 3: valve B; 301: inlet B; 302: valve seat B; 4: valve C; 401: inlet C; 402: valve seat C; 5: valve D; 501: inlet D; 502: valve seat D; 6: pump; 601: pump inlet; 602: pump outlet; 7: nozzle; 802: valve seat E; 902: valve seat F; 10: chamber 1; 11: plunger cap 1; 12: plunger 1; 13: solenoid coil 1; 14: chamber 2; 1401: outlet of chamber 2; 15: plunger cap 2; 16: plunger 2; 17: solenoid coil 2; a: bypass orifice A; b: bypass orifice B.

DETAILED DESCRIPTION OF THE EMBODIMENTS

Example 1

The detergent dosing controller refers to FIG. 1, equipped with main passage 1, one side is water inlet 101, another side is outlet 102 connecting to liquid inlet of washing bucket, valves A2, B3, C4, D5, pump 6 and nozzle 7 are equipped. Inlet of valve A connects to the bypass orifice Aa of the main passage; inlet of valve B connects to liquid storage tank of detergent A; outlets of valve A and valve B connect to inlet of valve C; inlet of valve D connects to liquid storage tank of detergent B; outlets of valve C and valve D connect to inlet 601 of the pump; outlet 602 of pump connects to bypass orifice Bb of the main passage. Relative location of bypass orifices A and B of main passage: bypass orifice A is relatively close to inlet 101 of main passage, bypass orifice B is relatively close to outlet 102 of main passage. The inlet diameter of the nozzle is smaller, while outlet diameter is the bigger, this nozzle connects to main passage by concatenation and between bypass orifices A and B, nozzle inlet faces to the inlet of main passage, while outlet faces to the outlet of main passage.

When the valve B3 and valve C4 are open, valve A2 and valve D5 are closed, pump 6 is started, detergent A will be sucked into main passage; when valve A and valve D are open, valve B and valve C are closed, the pump is started, detergent B will be sucked into main passage. Opening time of valve B and valve D can be controlled, namely the detergent dosing quantity can be controlled.

When valve A2 and valve C4 are open, valve B3 and valve D5 are closed, if main passage inlet 101 connects to water source, with the action of nozzle 7, water pressure at bypass orifice Aa will be higher than that at bypass orifice Bb, therefore, a bypass flow that flows from bypass orifice A to bypass orifice B can flush and clean the bypass passage.

Example 2

Figure 3:
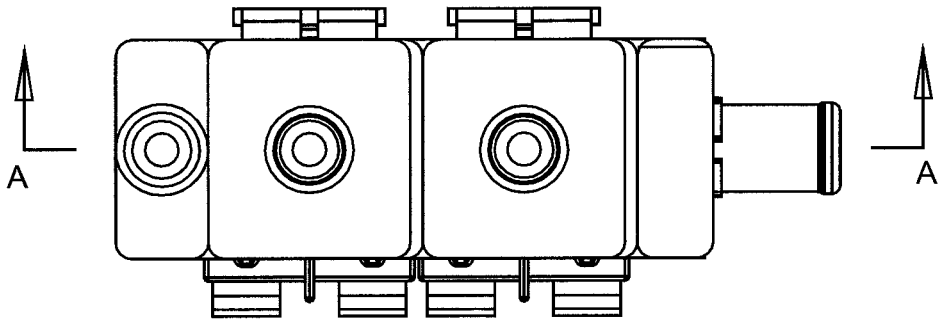
FIG. 3 is an Integrated Valve Outline Drawing of a Duplex Structure according to an Embodiment of the invention.
Figure 4:
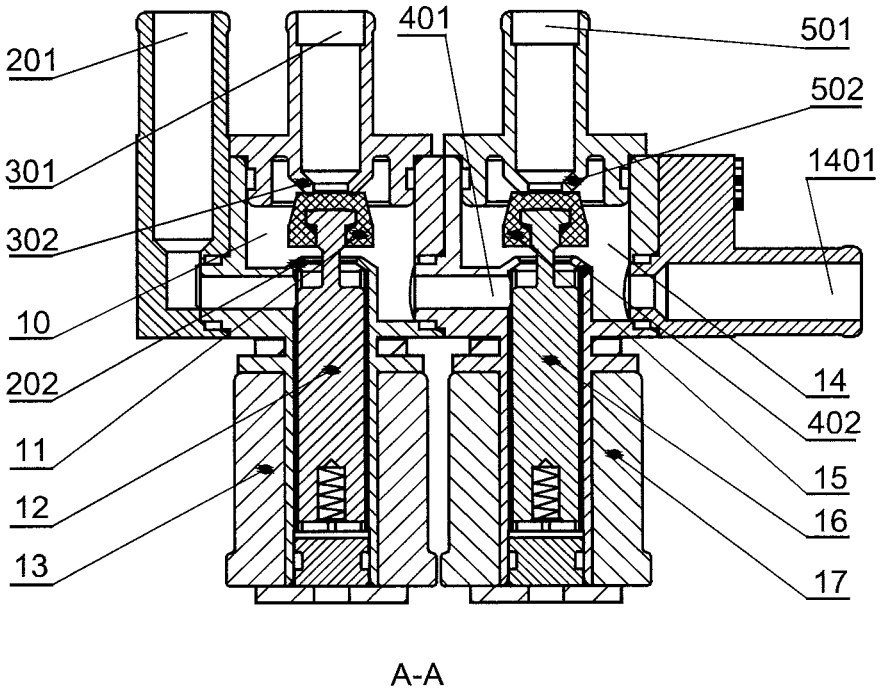
FIG. 4 is an A-A Section View of FIG. 3.
Figure 5:
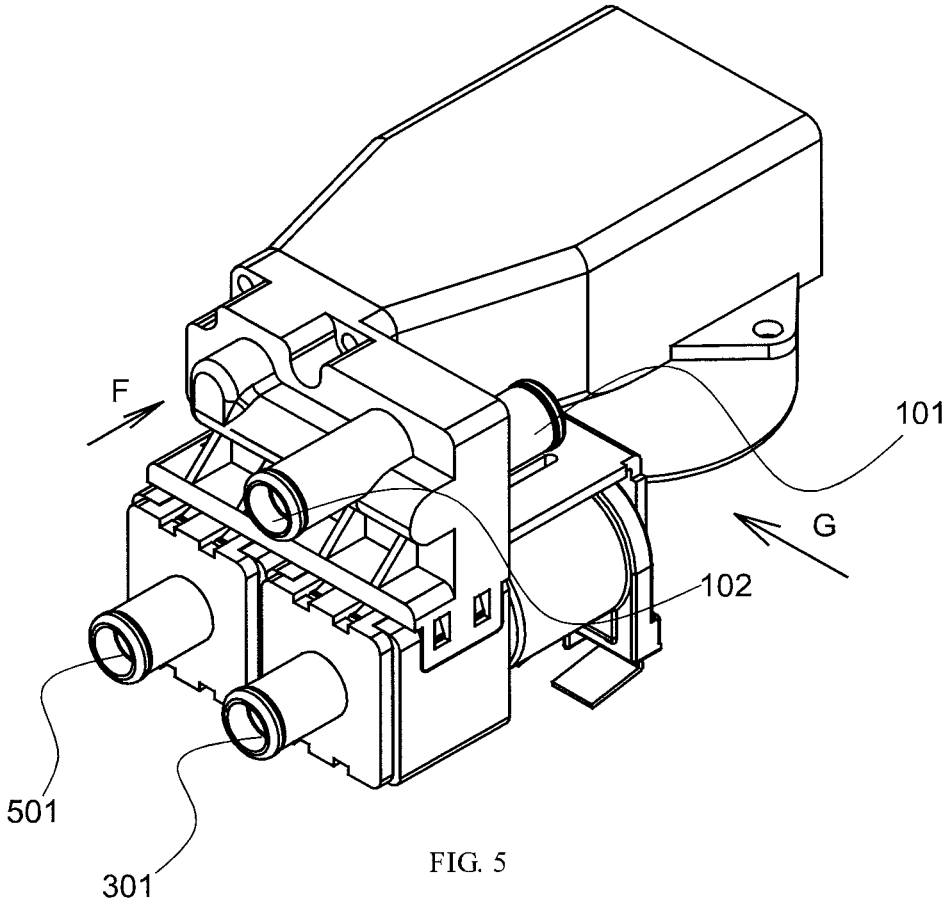
FIG. 5 is a Schematic Diagram of a Duplex Structure according to Another Embodiment of the invention.
Figure 6:
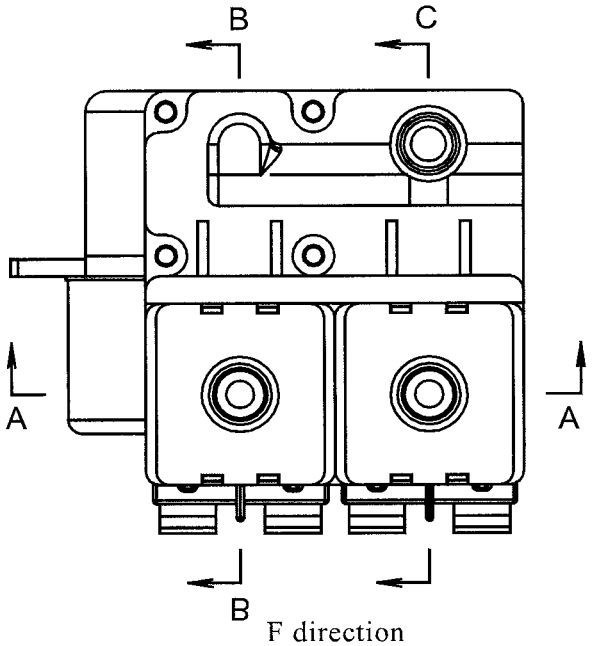
FIG. 6 is F-direction view of FIG. 5.
Figure 7:
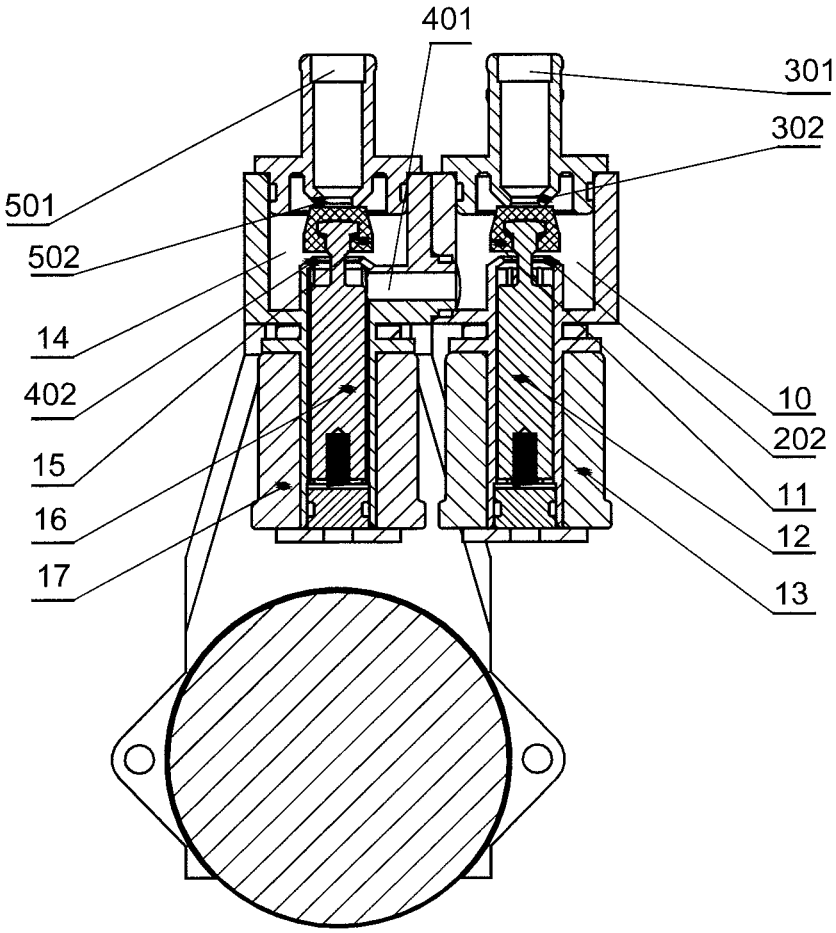
FIG. 7 is A-A Section View of FIG. 6.
Figure 8:
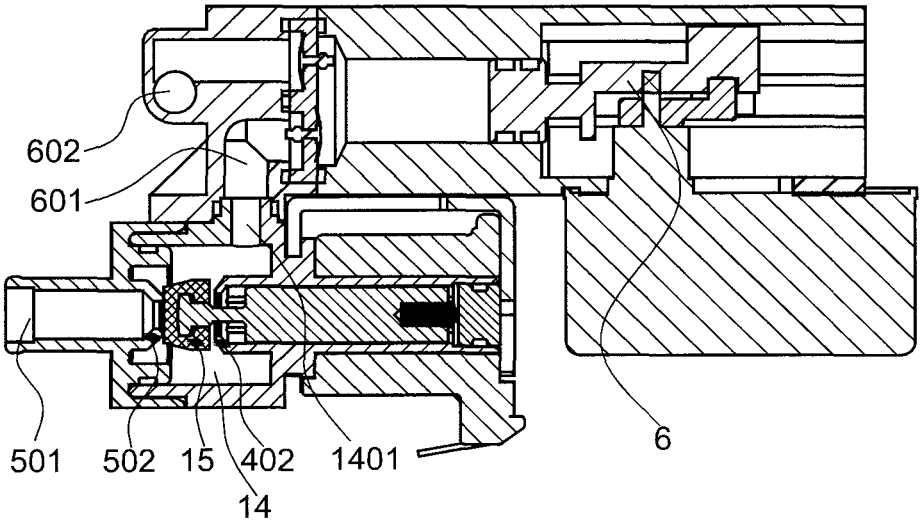
FIG. 8 is B-B Section View of FIG. 6.
Figure 9:
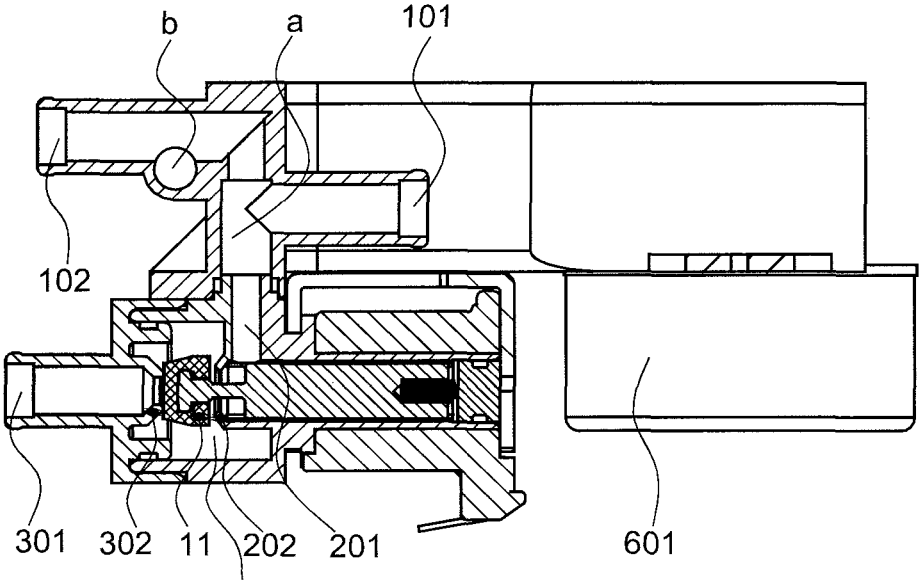
FIG. 9 is C-C Section View of FIG. 6.
Figure 10:
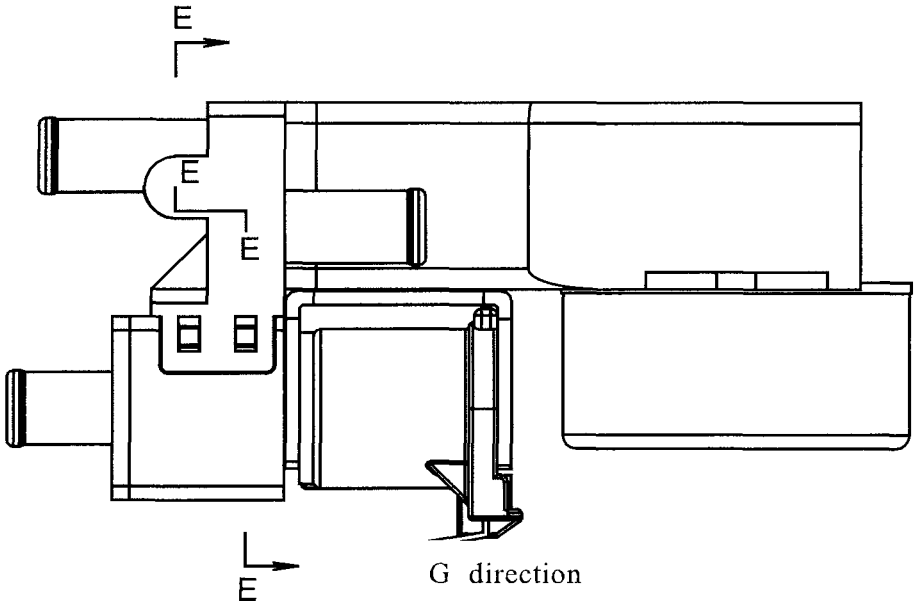
FIG. 10 is G-direction view of FIG. 5.
Figure 11:
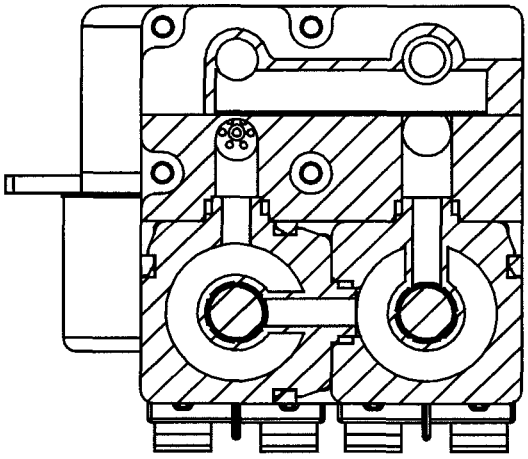
FIG. 11 is E-E Section View of FIG. 10.

The detergent dosing controller is equipped with main passage 1, one side is water inlet 101, another side is outlet 102 connecting to liquid inlet of washing bucket. It is equipped with an integrated valve as shown in FIG. 3 and FIG. 4. The integrated valve is equipped with valve A with inlet A201 and valve seat A202, valve B with inlet B301 and valve seat B302, valve C with inlet C401 and valve seat C402 and valve D with inlet D501 and valve seat D502. The integrated valve has chamber 1 (10) and chamber 2 (14), when valve seat A is under open state, chamber 1 connects to inlet A201, when valve seat C is under open state, chamber 1 connects to chamber 2. Chamber 2 has an outlet 1401, inlet A connects to bypass orifice Aa of main passage, outlet 1401 of chamber 2 connects to bypass orifice Bb of main passage. Bypass orifice A is relatively close to inlet 101 while bypass orifice B is relatively close to outlet 2. A nozzle is set between bypass orifice A and B of main passage, its inlet faces to the inlet of main passage, outlet faces to the outlet of main passage; this integrated valve is equipped with solenoid valve assembly 1 and 2; solenoid coil 1 (13) is equipped in solenoid valve assembly 1, in the guide sleeve, plunger 1 (12) is equipped and its front end connects to plunger cap 1 (11); solenoid coil 2 (17) is equipped in solenoid valve assembly 2, in the guide sleeve, plunger 2 (16) is equipped and its front end connects to plunger cap 2 (15);

The valve A and valve B correspond to solenoid valve assembly 1, valve seat A202 and valve seat B302 connect to chamber 1 (10) of integrated valve and face to axis in this chamber, keeping certain distance away from the axis, plunger cap 1 of solenoid valve assembly 1 is within the distance scope of valve seat A and valve seat B. Under normal state, plunger cap 1 can close valve seat B while open valve seat A, this normal state refers to non-energized state of solenoid coil 1.

The valve C and valve D correspond to solenoid valve assembly 2, valve seat C402 and valve seat D502 connect to chamber 2 (14) of integrated valve and face to axis in this chamber, keeping certain distance away from the axis, plunger cap 2 of solenoid valve assembly 2 is within the distance scope of valve seat C and valve seat D. Under normal state, plunger cap 2 can close valve seat D while open valve seat C, this normal state refers to non-energized state of solenoid coil 2.

In this example, valve A and valve B are interlinked; valve C and valve D are interlinked. When solenoid coil 1 (13) is not energized, plunger 1 (12) stretches out under the action of rear spring, plunger cap 1 (11) closes the valve seat B302 and opens valve seat A202, inlet A201 connects to chamber 1 (10); similarly, when solenoid coil 2 (17) is not energized, plunger 2 (16) stretches out under the action of rear spring, plunger cap 2 (15) closes the valve seat D502 and opens valve seat C402, chamber 1 (10) connects to chamber 2 (14). Under the above conditions, when the solenoid coil is energized, plunger 1 is closed, plunger cap 1 (11) closes seat valve A202 and opens valve seat B302, detergent A is fed. Similarly, the energized solenoid coil 2 can make detergent B fed.

In this example, valve A and valve B are interlinked; valve C and valve D are interlinked. Closing or opening of valve seats A, B, C and D refers to closing or opening of valves A, B, C and D.

When valve A is open, valve B is inevitably closed; when valve A is closed, valve B is inevitably open. Similarly, when valve C is open, valve D is inevitably closed; when valve C is closed, valve D is inevitably open.

When valve A is closed, valve B is open; when valve C is open, valve D is closed, pump is started, detergent A is sucked into main passage. When valve A is open, valve B is closed; when valve C is closed, valve D is open, pump is started, detergent B is sucked into main passage. The opening time of valve B and valve D can be controlled, namely detergent dosing quantity can be controlled.

When valve A and valve C are open, valve B and valve D are closed, the main passage inlet connects to water source, with the action of nozzle, water pressure at bypass orifice A will be higher than that at bypass orifice B, therefore, a bypass flow that flows from bypass orifice A to bypass orifice B can flush and clean the bypass passage.

Example 3

The detergent dosing controller is as shown in FIG. 5 to FIG. 11, it is equipped with an integrated body, a main passage is at upper right side of integrated body, one side is inlet 101, another side is outlet 102, pump 6 with motor 601 is at upper left side of integrated body, at lower side of integrated body, valve A with inlet A201 and valve seat A202, valve B with inlet B301 and valve seat B302, valve C with inlet C401 and valve seat C402, valve D with inlet D501 and valve seat D502 are equipped, and chamber 1 (10) and chamber 2 (14) are also equipped. Inlet A201 connects to bypass orifice Aa of main passage, when valve seat A is open, chamber 1 connects to inlet A201. When valve seat C is open, chamber 1 connects to chamber 2. Outlet 1401 in chamber 2 connects to pump inlet 601, pump outlet 602 connects to bypass orifice Bb of main passage. Bypass orifice A is relatively close to main passage inlet, while B is relatively close to main passage outlet. A nozzle is set between bypass orifices A and B of main passage, its inlet faces to the inlet of main passage, its outlet faces to the outlet of main passage; solenoid valve assembly 1 and solenoid valve assembly 2 are equipped at lower part of integrated body; solenoid coil 1 (13) is equipped in solenoid valve assembly 1, in the guide sleeve, plunger 1 (12) is equipped and its front end connects to plunger cap 1 (11); solenoid coil 2 (17) is equipped in solenoid valve assembly 2, in the guide sleeve, plunger 2 (16) is equipped and its front end connects to plunger cap 2 (15);

The valve A and valve B correspond to solenoid valve assembly 1, valve seat A202 and valve seat B302 connect to chamber 1 (10) of integrated valve and face to axis in this chamber, keeping certain distance away from the axis, plunger cap 1 of solenoid valve assembly 1 is within the distance scope of valve seat A and valve seat B. Under normal state, plunger cap 1 can close valve seat B while open valve seat A, this normal state refers to non-energized state of solenoid coil 1.

The valve C and valve D correspond to solenoid valve assembly 2, valve seat C402 and valve seat D502 connect to chamber 2 (14) of integrated valve and face to axis in this chamber, keeping certain distance away from the axis, plunger cap 2 of solenoid valve assembly 2 is within the distance scope of valve seat C and valve seat D. Under normal state, plunger cap 2 can close valve seat D while open valve seat C, this normal state refers to non-energized state of solenoid coil 2.

In this example, the working condition of detergent dosing controller is similar to that in example 2.

Example 4

Figure 2:
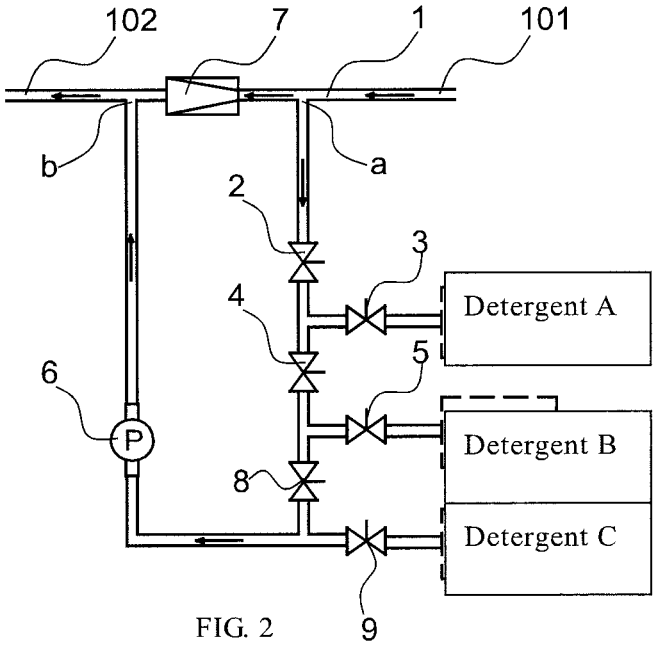
FIG. 2 is a Schematic Diagram of a Triple Structure.
Figure 12:
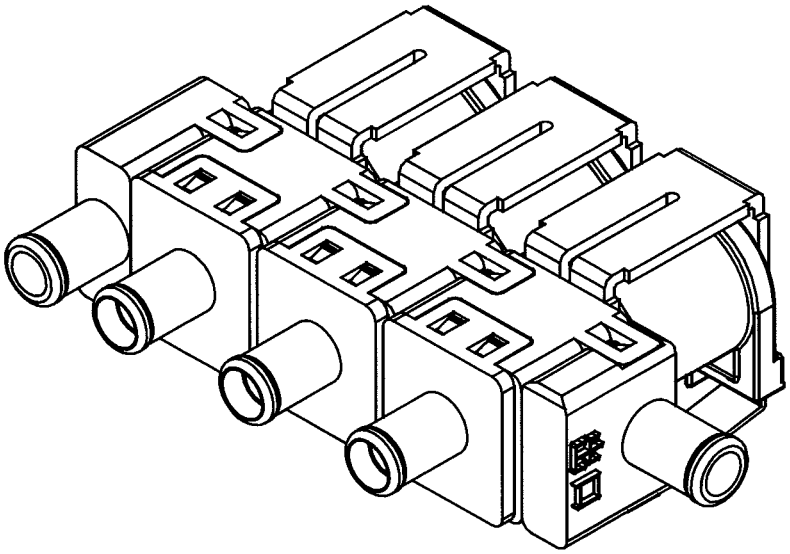
FIG. 12 is Integrated Valve Outline Drawing of Triple Structure according to an Embodiment of the invention.
Figure 13:
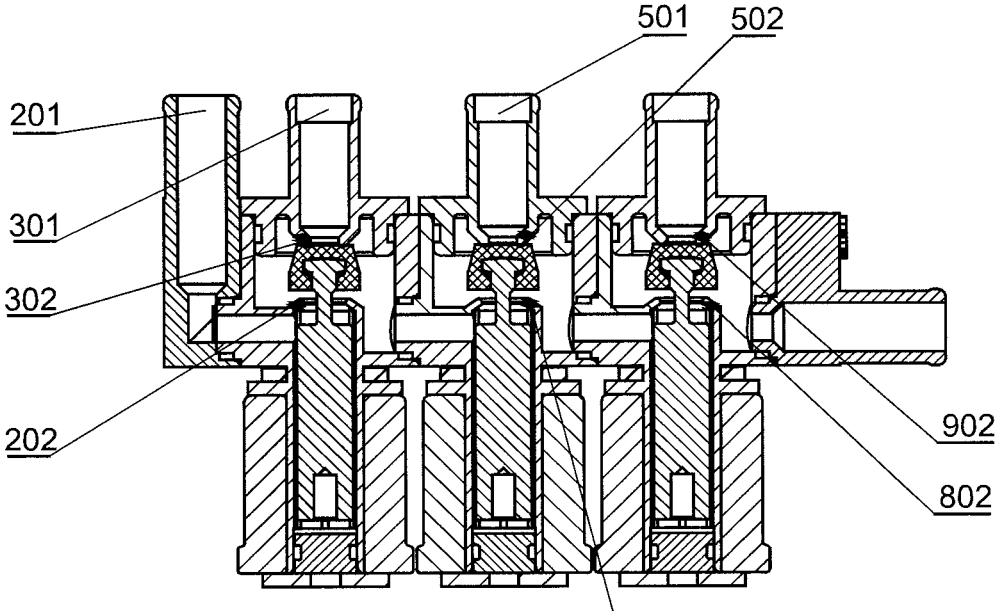
FIG. 13 is Section View of Integrated Valve in FIG. 12.

The detergent dosing controller refers to FIGS. 2, 12 and 12, equipped with main passage 1, one side is water inlet 101, another side is outlet 102 connecting to liquid inlet of washing bucket, an integrated valve is equipped, the integrated valve is equipped with valve A with valve seat A201, valve B with valve seat B302, valve C with valve seat C402, valve D with valve seat D502, valve E with valve seat E802 and valve F with valve seat F902; compared to example 2, valve E, valve F, chamber 3 and solenoid assembly 3 are supplemented, other structures are similar to example 2. The working condition of detergent dosing controller is similar to that of example 2 and example 3.

The invention claimed is:

1. A detergent dosing controller, comprising a main passage, one side is water inlet, another side is outlet connecting to liquid inlet of washing bucket, wherein valves, B, C, D, pump and nozzle are equipped, the inlet of valve A connects to a bypass orifice A of the main passage, inlet of valve B connects to liquid storage tank of detergent A, outlets of valve A and valve B connect to inlet of valve C, inlet of valve D connects to liquid storage tank of detergent B, outlets of valve C and valve D connect to inlet of the pump, outlet of pump connects to bypass orifice B of the main passage, and for the relative location of bypass orifices A and B of main passage, bypass orifice A is relatively close to an inlet of main passage, bypass orifice B is relatively close to outlet of main passage, the nozzle connects to main passage by concatenation and between bypass orifices A and B, nozzle inlet faces to the inlet of main passage, while nozzle outlet faces to the outlet of main passage, wherein an integrated valve is installed, the valves A, B, C and D are installed in the integrated valve, the valve A has inlet A and valve seat A, valve B has inlet Band valve seat B, valve C has inlet C and valve seat C, valve D has inlet D and valve seat D, the integrated valve has chamber 1 and chamber 2, when valve seat A is under open state, chamber 1 connects to inlet A, when valve seat C is under open state, chamber 1 connects to chamber 2, chamber 2 has an outlet, the integrated valve is equipped with solenoid valve assembly 1 and 2; solenoid coil 1 is equipped in solenoid valve assembly 1, in its guide sleeve, plunger 1 is equipped and its front end connects to plunger cap 1; solenoid coil 2 is equipped in solenoid valve assembly 2, in its guide sleeve, plunger 2 is equipped and its front end connects to plunger cap 2;

the valve A and valve B correspond to solenoid valve assembly 1, the valve seat A and valve seat B connect to chamber 1 of integrated valve and face to axis in chamber 1, certain distance away from the axis, plunger cap 1 of solenoid valve assembly 1 is within the distance scope of valve seat A and valve seat B, under normal state, plunger cap 1 can close valve seat B while open valve seat A; and the valve C and valve D correspond to solenoid valve assembly 2, valve seat C and valve seat D connect to chamber 2 of integrated valve and face to axis in chamber 1, certain distance away from the axis, plunger cap 2 of solenoid valve assembly 2 is within the distance scope of valve seat C and valve seat D, under normal state, plunger cap 2 can close valve seat D while opening valve seat C.

2. The detergent dosing controller according to claim 1, wherein an integrated body is installed, the pump, main passage with nozzle and integrated valve are equipped in the integrated body, the inlet A connects to bypass orifice A, inlet C connects to chamber 1 chamber 2 outlet connects to pump inlet.

3. The detergent dosing controller according to claim 2, wherein the main passage can be set at upper right part of integrated body, pump can be set at upper left part of integrated body, and the integrated valve can be set at lower part of integrated body, the pump is equipped with a motor.

4. A detergent dosing controller, comprising a main passage, one side is water inlet, another side is outlet connecting to liquid inlet of washing bucket, wherein it is equipped with valves A, B, C, D, E and F, pump and nozzle, inlet of valve A connects to a bypass orifice A of the main passage, inlet of valve B connects to liquid storage tank of detergent A, outlets of valve A and valve B connect to inlet of valve C; inlet of valve D connects to liquid storage tank of detergent B, outlets of valve C and valve D connect to inlet of valve E, inlet of valve F connects to liquid storage tank of detergent C, outlets of valve E and valve F connect to inlet of the pump, outlet of pump connects to bypass orifice B of the main passage, for the relative location of bypass orifice A and B of main passage, bypass orifice A is relatively close to an inlet of main passage, bypass orifice B is relatively close to the outlet of main passage, the nozzle connects to main passage by concatenation and between bypass orifice A and B, nozzle inlet faces to the inlet of main passage, while a nozzle outlet faces to the outlet of main passage; wherein an integrated valve is installed, the valves A, B, C, D, E and F are equipped in the integrated valve, they are equipped with valve seats A, B, C, D, E and F, the integrated valve has chambers 1, 2 and 3, when valve seat A is under open state, chamber 1 connects to inlet of valve A, when valve seat C is under open state, chamber 1 connects to chamber 2, when valve seat E is under open state, chamber 2 connects to chamber 3, chamber 3 has an outlet, the integrated valve is equipped with solenoid valve assembly 1, 2 and 3; solenoid coil 1 is equipped in solenoid valve assembly 1, in its guide sleeve, plunger 1 is equipped and its front end connects to plunger cap 1, solenoid coil 2 is equipped in solenoid valve assembly 2, in its guide sleeve, plunger 2 is equipped and its front end connects to plunger cap 2; solenoid coil 3 is equipped in solenoid valve assembly 3, in its guide sleeve, plunger 3 is equipped and its front end connects to plunger cap 3; the valve A and valve B correspond to solenoid valve assembly 1, valve seat A and valve seat B connect to chamber 1 of integrated valve and face to axis in chamber 1, (certain distance away from the axis), plunger cap 1 of solenoid valve assembly 1 is within the distance scope of valve seat A and valve seat B, under normal state, plunger cap 1 can close valve seat B while opening valve seat A; the valve C and valve D correspond to solenoid valve assembly 2, the valve seat C and valve seat D connect to chamber 2 of integrated valve and face to axis in chamber 2 (certain distance away from the axis), plunger cap 2 of solenoid valve assembly 2 is within the distance scope of valve seat C and valve seat D, under normal state, plunger cap 2 can close valve seat D while opening valve seat C; and the valve E and valve F correspond to solenoid valve assembly 3, valve seat E and valve seat F connect to chamber 3 of integrated valve and face to axis in chamber 3, keeping certain distance away from the axis, plunger cap 3 of solenoid valve assembly 3 is within the distance scope of valve seat E and valve seat F, under normal state, plunger cap 3 can close valve seat F while opening valve seat E.

* * * * *